US006726284B2

(12) United States Patent
Cleary

(10) Patent No.: US 6,726,284 B2
(45) Date of Patent: Apr. 27, 2004

(54) FURNITURE CONSTRUCTION AND METHOD

(76) Inventor: Bobby D. Cleary, 1412 Wisteria Ct., High Point, NC (US) 27265

( * ) Notice: Subject to any disclaimer, the term of this patent is extended or adjusted under 35 U.S.C. 154(b) by 0 days.

(21) Appl. No.: 10/055,681

(22) Filed: Jan. 23, 2002

(65) Prior Publication Data

US 2002/0063462 A1 May 30, 2002

Related U.S. Application Data

(63) Continuation of application No. 09/484,206, filed on Jan. 18, 2000, now abandoned.

(51) Int. Cl.[7] ..... A47C 7/54

(52) U.S. Cl. ..... 297/411.45; 297/411.46; 297/440.14; 297/227

(58) Field of Search ..... 297/411.2, 411.46, 297/440.1, 440.2, 440.14, 411.41, 411.45, 227; 248/345.1

(56) References Cited

U.S. PATENT DOCUMENTS

| | | | | | |
|---|---|---|---|---|---|
| 1,717,042 | A | * | 6/1929 | Kelly | 297/411.45 |
| 2,481,761 | A | * | 9/1949 | Leon | 297/411.46 X |
| 2,871,928 | A | * | 2/1959 | Swenson | 297/411.23 |
| 3,759,571 | A | * | 9/1973 | Korch | 297/411.45 X |
| 4,109,887 | A | * | 8/1978 | Wakeland, Jr. | 248/345.1 X |
| 4,285,544 | A | * | 8/1981 | Zapf | 297/218.3 X |
| 4,697,847 | A | * | 10/1987 | Herschlag | 297/42 X |

* cited by examiner

*Primary Examiner*—Anthony D. Barfield

(57) ABSTRACT

A method of constructing upholstered furniture is provided using unitary ends which are covered with molded polymeric foam cushions. The construction method saves time and reduces the cost of the finished furniture while allowing relatively unskilled workers to produce top quality furniture in an efficient manner.

12 Claims, 5 Drawing Sheets

FURNITURE CONSTRUCTION AND METHOD

This is a continuation of application Ser. No. 09/484,206 filed Jan. 18, 2000, now abandoned.

FIELD OF THE INVENTION

The invention herein pertains to a method of furniture construction and particularly to the construction of upholstered furniture as is mass produced commercially.

BACKGROUND AND OBJECTIVES OF THE INVENTION

Labor and material costs have escalated in recent years causing increased economic pressure on virtually all manufacturing operations. Nowhere can this pressure be felt more strongly than in the furniture industries such as in the manufacture of upholstered furniture. Manufacturers are constantly seeking ways to automate production and to reduce costs. Unfortunately some manufacturers, not being able to meet today's challenges have closed their doors.

The manufacture and assembly of upholstered furniture has always required the skill of competent workers since flexible fabrics and rigid frames must be joined in a seamless manner providing a functional yet aesthetically pleasing piece for the consumer. Talented upholsters that once permeated the furniture industry are for the most part gone, requiring manufacturing operations to automate, out source, and inspect the finished products at a greater degree than ever before. With the influx into the country of foreign manufactured furniture, retail stores have become increasingly price and quality conscious, once again placing pressure on domestic manufacturers to deliver flaw-free products, sometimes under stringent time schedules. Upholstered furniture such as chairs and sofas are conventionally formed from wooden frames or substructures which are built of various wooden components fastened together and precovered by manually forming planar foam cushions therearound. The planar foam cushions are then stapled and hand trimmed to provide the structure for an outer decorative fabric and other ornamental features in the completion phase. More recently, ends have been cut from single plywood sheets and polyfoam sheets have been sawed to form a groove or cavity into which the ends are slid. The ends have arms with straight top surfaces and the cavities are also linear to accommodate the arm top surfaces.

As would be understood, the construction of individual furniture frame parts, such as ends, backs, legs or the like require much time and effort and oftentimes such components are rejected as being out of specification. Additionally, the manual forming of cushion material around wooden substructures has also caused problems, due to lack of uniformity standards of individual workers and due to the speed required to meet production demands. Linear top arm surfaces are often undesirable for sophisticated furniture purchasers.

Thus, with the problems and disadvantages of current upholstered furniture manufacturing methods well documented, the present invention was conceived and one of its objectives is to provide furniture construction with the least possible number of different parts required in the substructure or frame, but which has interesting contours.

It is yet another objective of the present invention to provide a furniture construction method which utilizes unitary ends cut from single, conventional plywood sheets with arcuate arm top surfaces.

It is yet another objective of the present invention to provide molded polymeric foam components having arcuate cavities to complement the arm top surfaces which can be easily mounted thereto.

It is a further objective of the present invention to provide a method of manufacturing furniture whereby relatively unskilled persons can construct an upholstered furniture piece with an arcuate arm in a quick and efficient manner.

It is still another objective of the present invention to provide furniture construction which is uniform and inexpensive to manufacture.

Various other objectives and advantages of the present invention will become apparent to those skilled in the art as a more detailed description is set forth below.

SUMMARY OF THE INVENTION

The aforesaid and other objectives are realized by providing a furniture construction method of producing furniture in which unitary ends of chairs, sofas or the like are formed from for example, standard plywood sheets cut with an arcuate arm top surface. The furniture end which defines an arm along its top surface is then covered with a preformed polymeric cushion having a cavity which is shaped to complement the shape of the arm top surface and is secured thereto by staples or other standard fasteners. The end, which is uniformly cut does not vary in shape or thickness and is easily covered with the polymeric foam which has been molded to rigid tolerances. After the foam cushions are applied, opposing ends are joined with dowel pins into back and seat support members and the assembly is then completed as is usual in furniture manufacturing operations including the addition of legs, springs, covering with suitable fabrics and the addition of seat and back cushions and the like. The furniture construction method as described greatly increases the ability of a relatively unskilled laborer to produce upholstered furniture having arcuate arms of a top quality in an efficient and economical manner.

DETAILED DESCRIPTION OF THE PREFERRED EMBODIMENTS AND OPERATION OF THE INVENTION

Figures 1, 2:
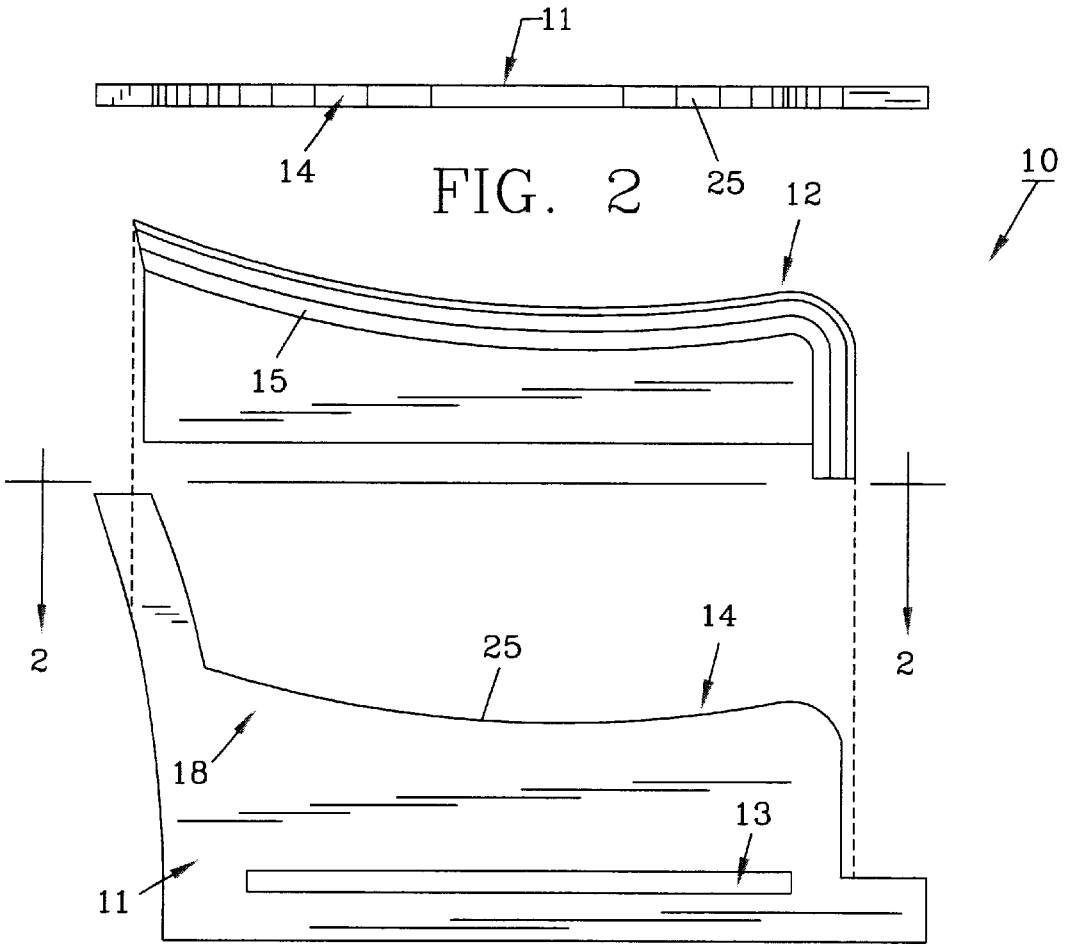
FIG. 1 shows a side view of an end of preferred furniture construction of the invention with the foam cushion exploded therefrom.
FIG. 2 demonstrates a top view of the furniture end as seen in FIG. 1 along lines 2—2.

For a better understanding of the invention including the method employed, turning now to the drawings, FIG. 1 shows preferred furniture construction 10 which includes furniture end 11 and molded polyurethane foam cushion 12. End 11 may be for example the left side of a chair, sofa, love seat or the like. End 11 comprises a unitary piece of wood, preferably plywood although it may be formed from other suitable woods, plastics or other materials and includes arcuate arm top surface 25. In FIG. 2 a top view of end 11 is shown demonstrating a thickness of approximately fifteen to twenty millimeters. No legs are shown attached to end 11 but preferably would be attached separately with screws or other fasteners. Fabric slot 13 allows for pulling excess fabric therethrough during the upholstering process as is usual in the trade.

Figure 4:
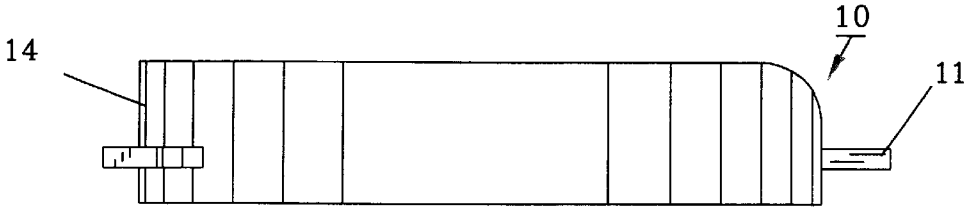
FIG. 4 depicts a top view of the furniture construction as seen in FIG. 3 along lines 4—4.
Figure 5:
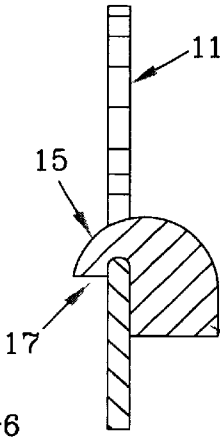
FIG. 5 features a cross-sectional view of the furniture construction as shown in FIG. 3 along lines 5—5.
Figure 6:
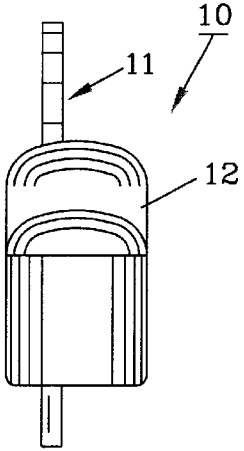
FIG. 6 pictures a front view of the furniture construction as shown in FIG. 3 along lines 6—6.
Figure 3:
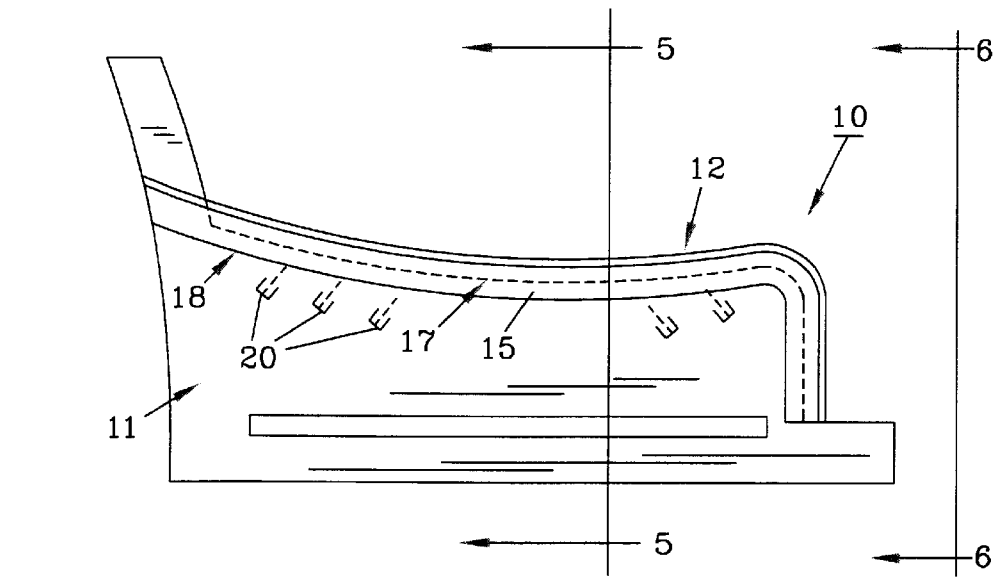
FIG. 3 illustrates the furniture construction as seen in FIG. 1 with the foam cushion in place prior to being secured thereon.
Figure 8:
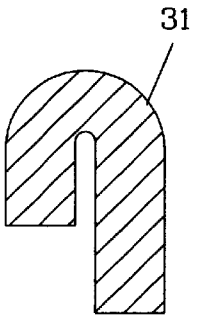
FIG. 8 demonstrates a cross-sectional view of the molded foam cushion as shown in FIG. 7 along lines 8—8.

Molded foam cushion 12 which is exploded from end 11 in FIG. 1 for illustrative purposes, is formed preferably by injection molding a polyurethane foam of a suitable density as is conventionally used in the furniture industry although other types of molded materials can be used. Molded foam cushion 12 has a somewhat inverted "J" shape in cross section as shown in FIG. 5 and is provided with an arcuate slot or cavity 17 for receiving arcuate top 25 of arm 14 seen in FIGS. 1 and 2. Molded foam cushion 12 has an arm covering portion 15 which is affixed to the outer surface of end 11 as seen in FIG. 3 by staples 20. Thus, by using unitary end 11 and molded foam cushion 12, one can easily assemble furniture construction 10 by simply sliding molded cushion 12 onto end 11 from above and thereafter stapling it securely in place. The opposite end of the chair or sofa is likewise assembled and thereafter the appropriate fabric coverings are affixed in place as is usual. In FIGS. 4 and 6 respectively a top and front view of end 11 with cushion 12 attached is shown to illustrate the shape obtained.

Figure 7:
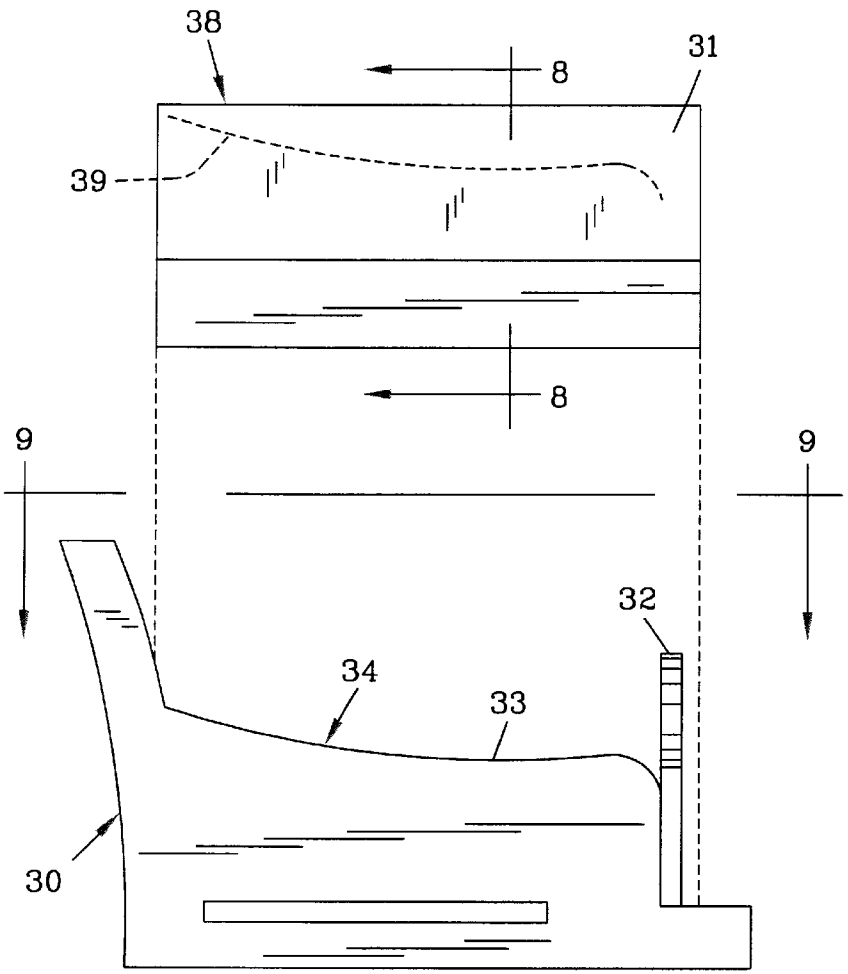
FIG. 7 shows another embodiment and end of the furniture construction with the molded foam cushion exploded therefrom.
Figure 10:
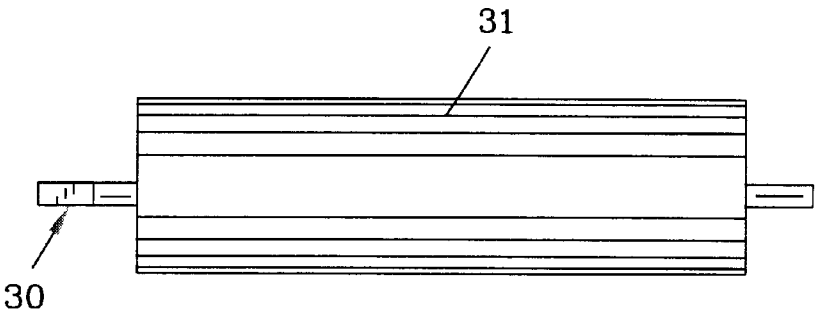
FIG. 10 illustrates a top view of the furniture end as shown in FIG. 7 but with the molded foam attached.
Figure 9:
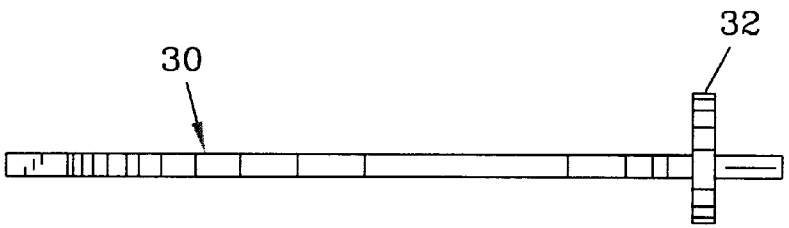
FIG. 9 depicts a top view of the furniture end as shown in FIG. 7 along lines 9—9.

An alternate embodiment of the invention is shown in FIGS. 7–10 whereby unitary end 30 is seen in FIG. 7 with foam cushion 31 having a somewhat inverted J-shape in cross section exploded therefrom. End 30 includes arm stud 32 which is formed as a separate element and attached to end 30 by conventional fasteners such as nails, staples, adhesives or the like. End 30 like previously described end 11 is formed from a unitary sheet of plywood of suitable thickness. Top surface 33 of arm 34 is curved as seen in FIG. 7. However, once molded cushion 31 is affixed, arm 34 then appears linear and level as shown in FIGS. 7 and 10, since molded foam cushion 31 accommodates for the curved effect as seen along arcuate cavity line 39 of FIG. 7. Thus, molded cushion 31 can create a different outer or top arm contour from the contour provided by top arm surface 33 of end 30 by having top surface 38 of molded cushion 31 follow a different line or contour than top surface 33 of arm 34. This provides flexibility and many available variations for the furniture designer yet does not increase the labor or cost in the assembly process. In FIG. 9, a top view of end 30 is shown with arm 32 attached before molded cushion 31 is placed thereon. In FIG. 10, molded cushion 31 is shown in place.

Figure 11:
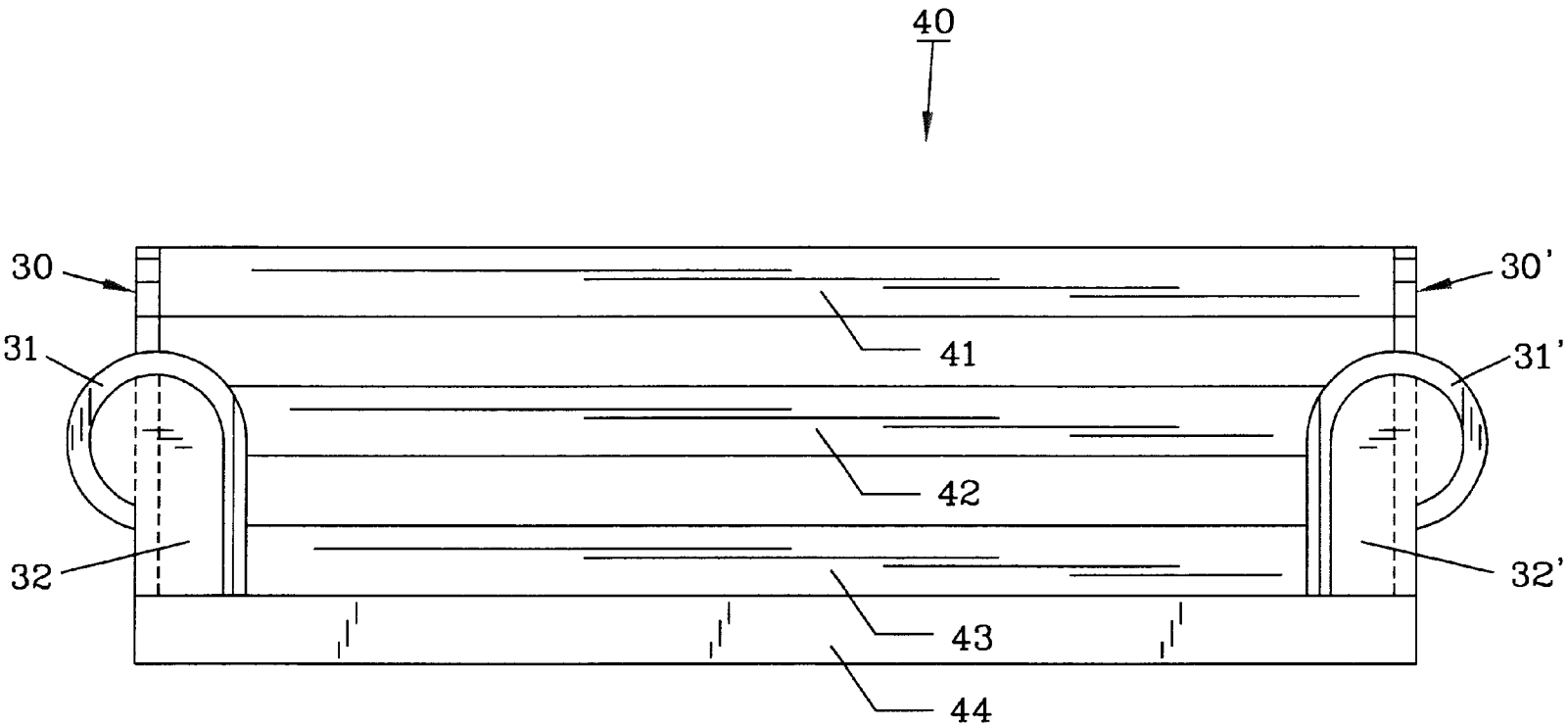
FIG. 11 features a sofa construction with the ends as shown in FIG. 7 attached.

In FIG. 11, sofa construction 40 is shown whereby identical ends 30, 31' are joined by back support members 41, 42 and 43 and seat support member 44. Molded foam cushions 31, 31' which are mirror images are shown in place and stretched over ends 30, 30' and arm studs 32, 32'.

The preferred method of constructing furniture as described above includes the steps of forming a unitary end such as end 30 shown in FIG. 7. Next, a foam cushion having an arcuate cavity complementary to the arm top surface molded from a suitable resilient material such as a polyurethane is placed on end 30 and is secured in place such as by staples, adhesives or other suitable fasteners. Next, the opposite end is likewise assembled and the assembled ends are then affixed, for example by dowel pins to back support slats such as back support slats 41–44 as shown in FIG. 11. Thereafter, the furniture is then upholstered as is conventional in the trade and completed with springs, cushions and the like.

Thus, by utilizing molded polyurethane foam cushions which have arcuate, complementary cavities ready to place on the ends of chairs, sofas or the like, a great deal of time and expense can be eliminated from the method of assembling furniture while resulting in more uniform, interesting furniture shapes at cost savings and more economical products for the consumers.

The illustrations and examples provided herein are for explanatory purposes and are not intended to limit the scope of the appended claims.

I claim:

1. Furniture construction comprising: a first unitary end, said first end formed from a single wooden sheet, said end defining an arcuate arm with an arc extending substantially the entire longitudinal length of said end, a first molded cushion, said first molded cushion defining a cavity, said cavity complementary to said arm for receiving said first arm, said cushion contacting said arcuate arm along its entire longitudinal length.

2. The furniture construction of claim 1 further comprising a back, said back affixed to said first end.

3. The furniture construction of claim 1 wherein said first end comprises plywood.

4. The furniture construction of claim 1 wherein said first unitary end defines a fabric slot.

5. The furniture construction of claim 1 further comprising a second unitary end, a second molded cushion, said second molded cushion attached to said second end.

6. The furniture construction of claim 1 wherein said molded cushion comprises polyurethane.

7. Furniture construction as claimed in claim 6 wherein said molded polyurethane cushion has an inverted J-shape in cross section.

8. Furniture construction comprising:

first and second unitary ends, said ends formed from wooden sheets, each end defining an arcuate arm, each said arm extending the entire longitudinal length of said end, first and second molded end cushions, said end cushions each defining cavities for receiving one of said ends, each of said cavities having complementary arcuate surfaces for said arms, a back, said first and said second ends affixed to said back at opposite ends thereof, said cushions each contacting different arms along their entire longitudinal length, and a plurality of fasteners, each of said cushions affixed to different ones of said ends with said fasteners, and said first and second ends each defining a fabric slot.

9. The furniture construction of claim 9 wherein said molded end cushions each have a top surface contour different from the contour of said end top surfaces.

10. The furniture construction of claim 8 wherein said molded end cushions each have a top surface contour identical to the contour of said end top surfaces.

11. Furniture construction comprising: a first unitary end, said first end formed form a single plywood sheet having a uniform thickness, said first end defining an arcuate arm extending the entire longitudinal length of said end, a first molded cushion, said first molded cushion formed from a polymeric material, said cushion defining an arcuate cavity, said cavity complementary to said arcuate arm, said cushion cavity contacting said arcuate arm essentially along its entire longitudinal length, and a fastener, said fastener maintaining said molded cushion on said first end.

12. Furniture construction as claimed in claim 11 wherein said fastener comprises a staple.

* * * * *